US011769965B2

(12) United States Patent
Chen

(10) Patent No.: US 11,769,965 B2
(45) Date of Patent: Sep. 26, 2023

(54) ELECTRIC CONNECTOR AND LED LAMP

(71) Applicant: XIAMEN GHGM INDUSTRIAL TRADE CO., LTD, Xiamen (CN)

(72) Inventor: Bingshui Chen, Xiamen (CN)

( * ) Notice: Subject to any disclaimer, the term of this patent is extended or adjusted under 35 U.S.C. 154(b) by 10 days.

(21) Appl. No.: 17/534,269

(22) Filed: Nov. 23, 2021

(65) Prior Publication Data

US 2023/0006394 A1 Jan. 5, 2023

(30) Foreign Application Priority Data

Jul. 2, 2021 (CN) ..... 202110753591.X

(51) Int. Cl.

| | |
|---|---|
| ***H01R 13/627*** | (2006.01) |
| ***F21V 23/06*** | (2006.01) |
| ***H01R 13/422*** | (2006.01) |
| *F21Y 115/10* | (2016.01) |

(52) U.S. Cl.

CPC ..... *H01R 13/6273* (2013.01); *F21V 23/06* (2013.01); *H01R 13/4223* (2013.01); *F21Y 2115/10* (2016.08)

(58) Field of Classification Search

CPC ..... H01R 4/48; H01R 4/4809; H01R 4/4818; H01R 13/4223; H01R 13/432; H01R 13/6273; H01R 13/28

USPC ..... 439/436–441, 733.1, 284, 287, 290, 291

See application file for complete search history.

(56) References Cited

U.S. PATENT DOCUMENTS

| | | | | |
|---|---|---|---|---|
| 3,091,746 A * | 5/1963 | Winkler | H01R 13/28 | 439/744 |
| 4,455,056 A * | 6/1984 | Herrmann, Jr. | H01R 13/53 | 439/732 |
| 4,963,102 A * | 10/1990 | Gettig | H01R 24/84 | 439/291 |
| 5,190,482 A * | 3/1993 | VanDerStuyf | H01R 13/424 | 439/733.1 |
| 5,205,757 A * | 4/1993 | Hertelendy | H01R 4/4818 | 439/441 |
| 7,628,640 B2 * | 12/2009 | Radle | H01R 4/5008 | 439/441 |
| 7,704,095 B2 * | 4/2010 | Stromiedel | H01R 4/4818 | 439/441 |

(Continued)

*Primary Examiner* — Marcus E Harcum

(74) *Attorney, Agent, or Firm* — THE LAW OFFICE OF AUSTIN BONDERER, PC; Austin Bonderer

(57) ABSTRACT

An electric connector comprises a male terminal and a female terminal. The male terminal comprises a first connecting member, a first elastic member, a first wire opening, and a first connecting opening. The first elastic member comprises a first elastic arm extending towards the first connecting member and being configured to be inserted through the first wire opening, and the first connecting member is configured to be inserted through the first connecting opening. The female terminal comprises a second connecting member, a second elastic member, a second wire opening, and a second connecting opening. The second elastic member comprises a second elastic arm extending towards the second connecting member and being configured to be inserted though the second wire opening, and the second connecting member is configured to extend through the second connecting opening. The first connecting member and the second connecting member are in electrical contact with each other.

6 Claims, 7 Drawing Sheets

(56) References Cited

U.S. PATENT DOCUMENTS

| | | | | |
|---|---|---|---|---|
| 7,963,790 | B1 * | 6/2011 | Winter, Jr. | H01R 13/53 439/341 |
| 8,187,023 | B1 * | 5/2012 | Chen | H01R 4/22 439/441 |
| 8,262,405 | B1 * | 9/2012 | Bishop | H01R 4/4845 439/439 |
| 8,454,378 | B2 * | 6/2013 | Osterhart | H01R 24/84 439/284 |
| 9,634,414 | B1 * | 4/2017 | Chen | H01R 33/09 |
| 9,972,931 | B1 * | 5/2018 | Chen | H01R 13/04 |
| 9,972,953 | B1 * | 5/2018 | Zamora | H01R 13/26 |
| 10,153,562 | B1 * | 12/2018 | Chen | H01R 13/506 |
| 10,153,573 | B1 * | 12/2018 | Chen | H01R 13/20 |
| 10,886,640 | B2 * | 1/2021 | Zhang | H01R 4/28 |
| 10,992,067 | B2 * | 4/2021 | Geske | H01R 4/4836 |
| 2018/0351290 | A1 * | 12/2018 | Shi | H01R 13/5829 |
| 2022/0271447 | A1 * | 8/2022 | Meier | H01R 4/4818 |

* cited by examiner

ELECTRIC CONNECTOR AND LED LAMP

CROSS REFERENCE TO RELATED APPLICATION

This application claims the priority benefit of Chinese Patent Application No. 202110753591.X, filed on Jul. 2, 2021, which is hereby incorporated by reference in its entirety.

TECHNICAL FIELD

The present application relates to the technical field of electric devices, and, in particular, to an electric connector and LED lamp.

BACKGROUND

As for the existing electric connectors, the method of connecting an external conductor to the connector comprises opening a housing of the terminal, fixedly connecting the conductor and the terminal by a connecting member, and closing the housing. The wiring of this kind of structure is complicated, which is not conducive to plugging and disconnecting, and the operation is extremely inconvenient.

In order to avoid the above-mentioned problems, the electric connectors currently on the market realize the quick-plug connection between the conductors butted on different terminal sides through the mutual disassembly and assembly of the male end and the female terminal. It simplifies the connection between the conductors and makes the conductor insertion operation more convenient. However, the applicant found that although the male-female butted connection is convenient, the mounting and coordination of the internal conductive elements are more complicated, which makes the assembly of the conductive elements inconvenient and impairs the wiring clamping effect to a large extent. The contact tightness of the conductive element in the terminal is poor, resulting in unstable electric connections and poor reliability. In addition, the mounting and positioning of the conductive element in the terminal are not firm, and it is inevitably prone to loosening, which directly affects the connecting operation of the conductor and the terminal.

It should be mentioned that the information disclosed in this background section is only intended to increase the understanding of the overall background of the present application, and should not be regarded as an acknowledgement or any form of suggestion that the information constitutes already known to those of ordinary skill in the art.

SUMMARY

In view of this, the purpose of the present application is to provide an electrical connector and an LED lamp to solve the above-mentioned problems.

The present application provides an electric connector, comprising a male terminal and a female terminal detachably and electrically connected together. The male terminal comprises a first connecting member, a first elastic member, a first wire opening, and a first connecting opening; and the first elastic member comprises a first elastic arm that extends towards the first connecting member and is configured to be inserted through the first wire opening, and the first connecting member is configured to be inserted through the first connecting opening. The female terminal comprises a second connecting member, a second elastic member, a second wire opening, and a second connecting opening; the second elastic member comprises a second elastic arm that extends towards the second connecting member; the second elastic member is configured to be inserted though the second wire opening, and the second connecting member is configured to extend through the second connecting opening; and the first connecting member and the second connecting member are in electrical contact with each other.

Further, the male terminal is provided with a first mounting cavity and a second mounting cavity in communication with each other, and the first mounting cavity is located where the first wire opening is provided and communicates with the first wire opening; the second mounting cavity is located where the first wire opening is provided and communicates with the first wire opening.

Further, a partition plate is provided between the first mounting cavity and the second mounting cavity.

Further, a lower part of the first mounting cavity is provided with a first clamping protrusion and a limiting slot for mounting of two sides of the first connecting member, the first connecting member is provided with a hollow opening that matches with the first clamping protrusion and a step that matches with the partition plate.

Further, an upper part of the first mounting cavity is provided with a mounting groove for mounting of two sides of the first elastic member and a second clamping protrusion for restricting the first elastic member at a mounting position, and the second clamping protrusion cooperates with the first elastic member to prevent the first elastic member from detaching towards a direction of the first wire opening.

Further, at least one side of the first elastic member is provided with a clamping portion, and the clamping portion is clamped with the mounting groove to produce movement resistance.

Further, the first elastic member comprises an elastic arm and a limit arm that limits the deformation degree of the elastic arm, and the elastic arm applies pressure to the wire so that the conductor of the wire is closely abutted against the first connecting member.

Further, the first connecting member comprises an electric connecting section connected with the conductor and a matching section electrically connected with the second connecting member of the female terminal, the electric connecting section is closely abutted against a bottom surface of the first mounting cavity, and the matching section is closely abutted against a bottom surface of the second mounting cavity.

The present application further provides an LED lamp which comprises a lamp body and the electric connector.

Other features of the present application are apparent according to the description of the exemplary embodiments in conjunction with the drawings below.

BRIEF DESCRIPTION OF THE DRAWINGS

In order to explain the technical solutions of the embodiments of the present application more clearly, the following will briefly introduce the drawings that is used in the embodiments. It should be understood that the following drawings only show certain embodiments of the present application, and therefore should not be regarded as a limitation of the scope. For those of ordinary skill in the art, other related drawings can be obtained based on these drawings without an inventive step.

DETAILED DESCRIPTION OF EMBODIMENTS

Figure 1:
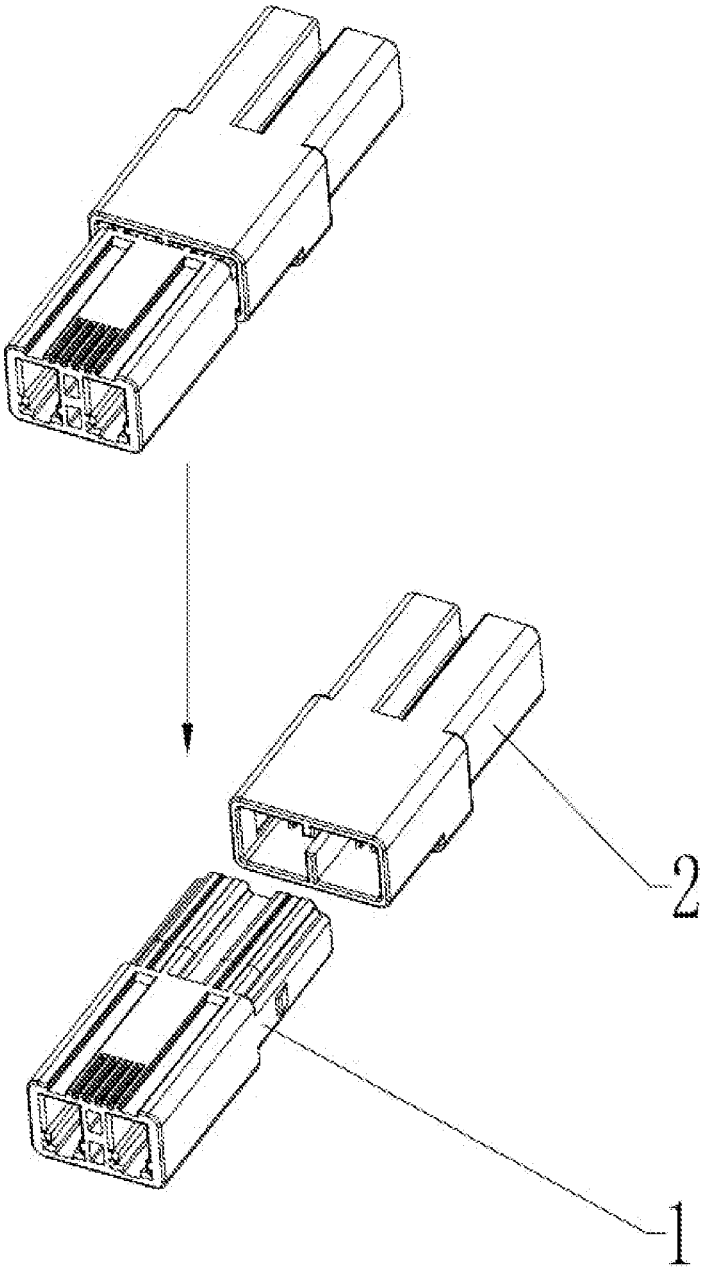
FIG. 1 is a schematic view of the structure of an electric connector according to an embodiment of the present application, in which the direction of the arrow is a schematic view of the disassembly of the male and female terminals.
Figure 2:
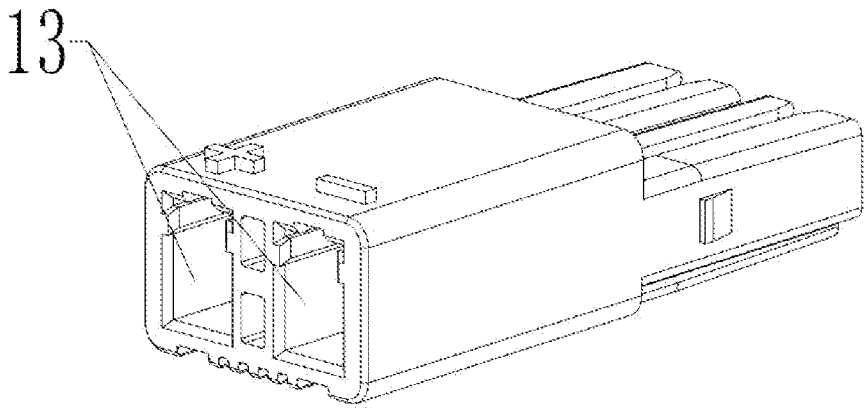
FIG. 2 is a schematic view of the structure of the male terminal of the electric connector according to an embodiment of the present application.

In order to make the objectives, technical solutions, and advantages of the embodiments of the present application clearer, the technical solutions in the embodiments of the present application will be described clearly and completely in conjunction with the accompanying drawings in the embodiments of the present application. Obviously, the described embodiments It is a part of the embodiments of the present application, but not all of the embodiments.

Embodiments

Referring to FIGS. 1 to 5, this embodiment provides an electric connector comprising a male terminal 1 and a female terminal 2, and the male terminal 1 and the female terminal 2 are electrically connected together in a detachable manner. The male terminal 1 comprises a first connecting member 11, a first elastic member 12, a first wire opening 13, and a first connecting opening 14. The first elastic member 12 can apply pressure to a wire to make the conductor of the wire closely abutted against the first connecting member 11. The first elastic member 12 and the wire pass through the first wire opening 13 and are mounted in the male terminal 1, and the first connecting member 11 passes through the first connecting opening 14 and is mounted in the male terminal 1 to establish the electrical connection of the first connecting member 11 to the conductor.

In the above embodiment, a first wire opening 13 is defined on one of the outer ends of the male terminal 1 to allow an external conductor to be clamped in the conductive element of the male terminal 1, which facilitates further electric connection to the female terminal 2 and thus electric connection to a conductor externally connected at one side of the female terminal 2. A first connecting opening 14 disposed opposite to the first wire opening 13 is defined on the other outer end of the male terminal 1, and the first connecting opening 14 is used to disassemble and assemble with the female terminal 2. The first connecting member 11 and the first elastic member 12 are separately provided so that the first elastic member 12 is configured to be able to pass through the first wire opening 13 and be mounted and limited in the terminal. Also, the first connecting member 11 is configured to be able to pass through the first opening and firmly mounted at the mounting position in the terminal. In this way, a clamping opening capable of elastically clamping the conductor is defined between the first elastic member 12 and the first connecting member 11. Therefore, the elastic force provided by the first elastic member 12 to the conductor in the clamping direction enables the conductor to stably and closely contact the first connecting member 11 to achieve an electric connection.

In this configuration, it is ensured that the two conductive elements in the male terminal 1 can be disassembled and assembled in different horizontal directions so that the assembly of the first connecting member 11 can be highly adapted to the plugging operation of the conductor in the terminal. Specifically, when a conductor is inserted at the side of the first wire opening 13, the first connecting member 11 receives a thrust along the insertion direction and mechanically and electrically contacts and fits the conductive element in the female terminal 2. Further, when the conductor is pulled out at the side of the first wire opening 13, the first connecting member 11 receives a pulling force along the pulling-out direction consistent with the assembling direction of the first connecting member 11. In this way, the first connecting member 11 is further mounted in place so that it is firmly confined in the mounting position. Therefore, the movement and detachment of the first connecting member 11 can be effectively prevented, thus maintaining the formed elastic force stable.

Among them, one of the embodiments of the above-mentioned conductor is an electric wire with an insulating layer peeled off at the end. Moreover, the conductive element of the male terminal 1 can be, but is not limited to, components such as electrical connectors and elastic members.

Figure 3:
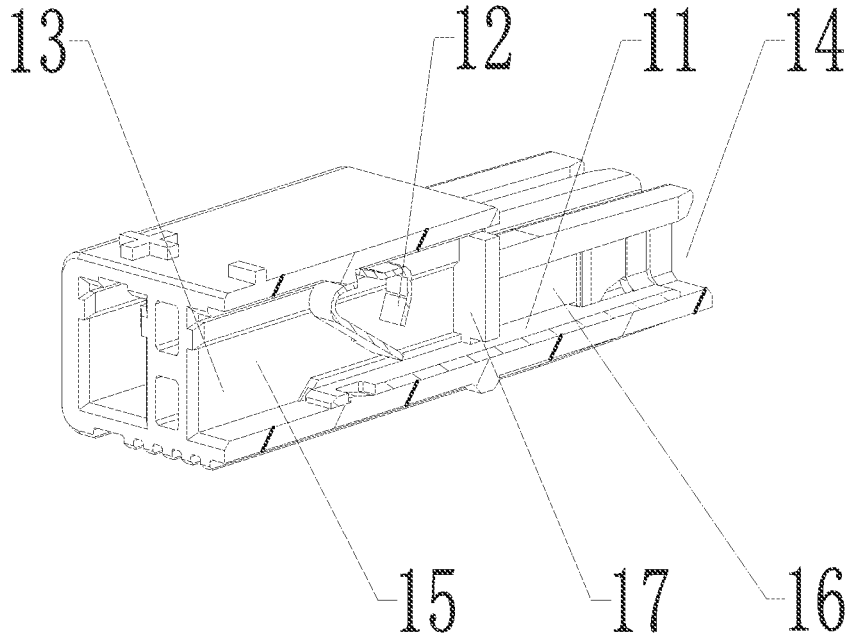
FIG. 3 is a cross-sectional view in FIG. 2.
Figure 4:
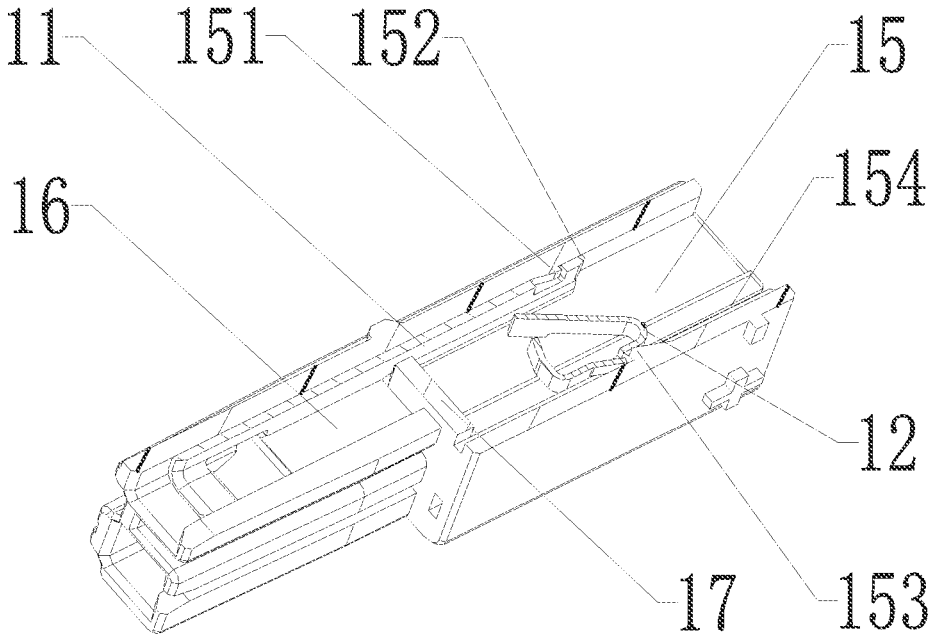
FIG. 4 is a cross-sectional view of FIG. 3 from another perspective.

As shown in FIGS. 3 and 4, the male terminal 1 is provided with a first mounting cavity 15 and a second mounting cavity 16 communicating with each other. The first mounting cavity 15 is located at the side of the first wire opening 13 and communicates with the first wire opening 13. Correspondingly, the second mounting cavity 16 is located at the side of the first connecting opening 14 and communicates with the first connecting opening 14. The first wire opening 13 and the first connecting opening 14 are engaged and matched via the first mounting cavity 15 and the second mounting cavity 16 to form a wire insertion space in the male terminal 1 which facilitates the entry of the conductor along the wire openings.

Among them, a partition plate 17 is provided between the first mounting cavity 15 and the second mounting cavity 16, and the partition plate 17 is arranged in the male terminal 1 to define two different mounting cavities so that the power supply connector and the elastic member can be assembled and matched properly.

Specifically, an inner lower part of the first mounting cavity 15 is provided with a first clamping protrusion 151 and a limiting groove 152 for mounting of both sides of the first connecting member. The first connecting member 11 is provided with a hollow opening 113 matched with the first clamping protrusion 151 and a step 114 matched with the partition plate 17. Therefore, the first connecting member 11 enters along the first connecting opening 14 until it reaches its mounting position. On the one hand, the hollow opening 113 is engaged with the first clamping protrusion 151 to ensure that the electric connector is mounted in place in the male terminal 1. On the other hand, through the in-place cooperation between the partition plate 17 and the corresponding step 114 of the electric connector, the accurate mounting and alignment are achieved, and the assembly is achieved well. The second mounting cavity 16 and the first mounting cavity 15 are communicated through a through opening opened at the partition plate 17, to allow the first connecting member 11 to enter the first mounting cavity 15 along the through opening, and the step 114 is precisely matched with the through opening.

Figure 5:
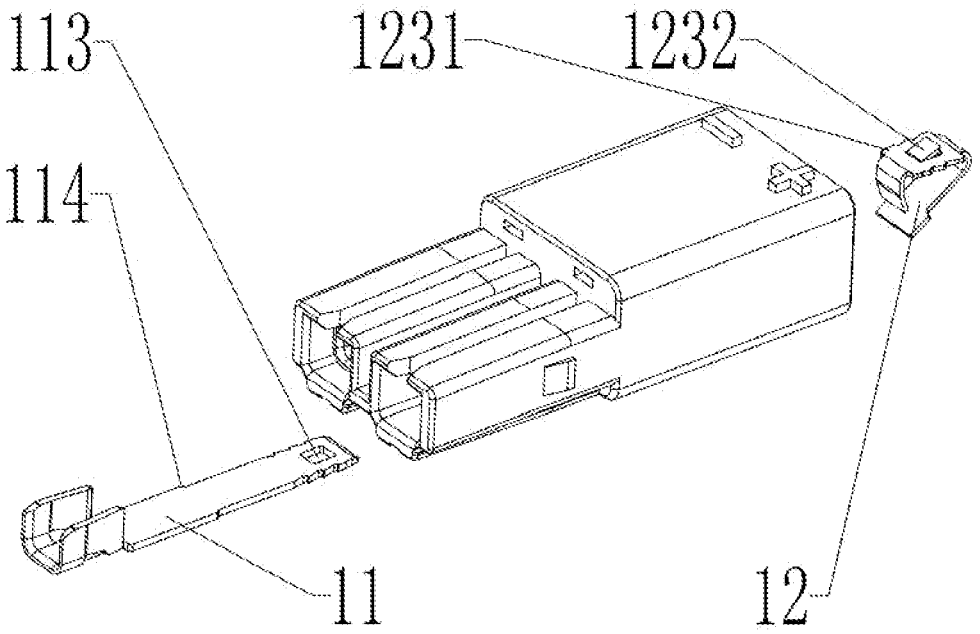
FIG. 5 is a schematic view of disassembling the male terminal of the electric connector according to an embodiment of the present application.

In addition, an upper part of the first mounting cavity 15 is provided with mounting grooves 154 for mounting of both sides of the first elastic member 12 and a second clamping protrusion 153 that restricts the first elastic member 12 at its mounting position. The second clamping protrusion 153 cooperates with the first elastic member 12 to prevent the first elastic member 12 from detaching towards the first wire opening 13. The specific matching of the second clamping protrusion 153 and the first elastic member 12, as shown in FIGS. 4 and 5, is achieved in that the male terminal 1 is formed with the second clamping protrusion 153 on the inner wall of the first mounting cavity 15, and the first elastic member 12 is provided with a support arm 1232 that cooperates with the second clamping protrusion 153. The support arm 1232 is arranged obliquely in the form of an elastic piece on the end surface of the first elastic member 12 facing the clamping protrusion, and the inclination direction of the support arm 1232 is provided such as to protrude outward along the mounting direction of the first elastic member 12, to facilitate smooth matching into the clamping protrusion. Further, after the clamping, a limit match can be formed between the support arm 1232 and the clamping protrusion to prevent the elastic member from running out of position during the process of plugging and unplugging the conductor.

In the above, any of the engaging protrusions are configured as an oblique body with a guiding slope, and the guiding slope is oriented to facilitate the gradually inclined arrangement of the electric connector/elastic member in the direction of the respective mounting and assembly to quickly assemble in place.

As shown in FIGS. 4 and 5, at least one side of the first elastic member 12 is provided with a clamping portion 1231, and the clamping portion 1231 is clamped with the mounting groove 154 to generate movement resistance. Therefore, the first elastic member 12 is assembled into the first mounting cavity 15 along the assembly direction and is inserted into the mounting groove 154 through the clamping portion 1231 to be slidably fitted until the first elastic member 12 is mounted in place.

Specifically, a stop portion is provided on the mounting groove 154, and the stop portion is matched with an end of the first elastic member 12. The stop portion is formed on an inner end of the mounting groove 154, and the first elastic member 12 moves until the clamping portion 1231 of the first elastic member 12 engages with the stop portion, to be firmly confined in the first mounting cavity 15.

In one embodiment, the left and right sides of the first elastic member 12 are both provided with a clamping portion 1231, and the mounting grooves 154 are correspondingly arranged on both sides of the first mounting cavity 15. The outer ends of the mounting grooves 154 penetrate to the outside of the first wire opening 13 to facilitate quick assembly of the first elastic member 12 into the first mounting cavity 15 along the first wire opening 13.

Figure 11:
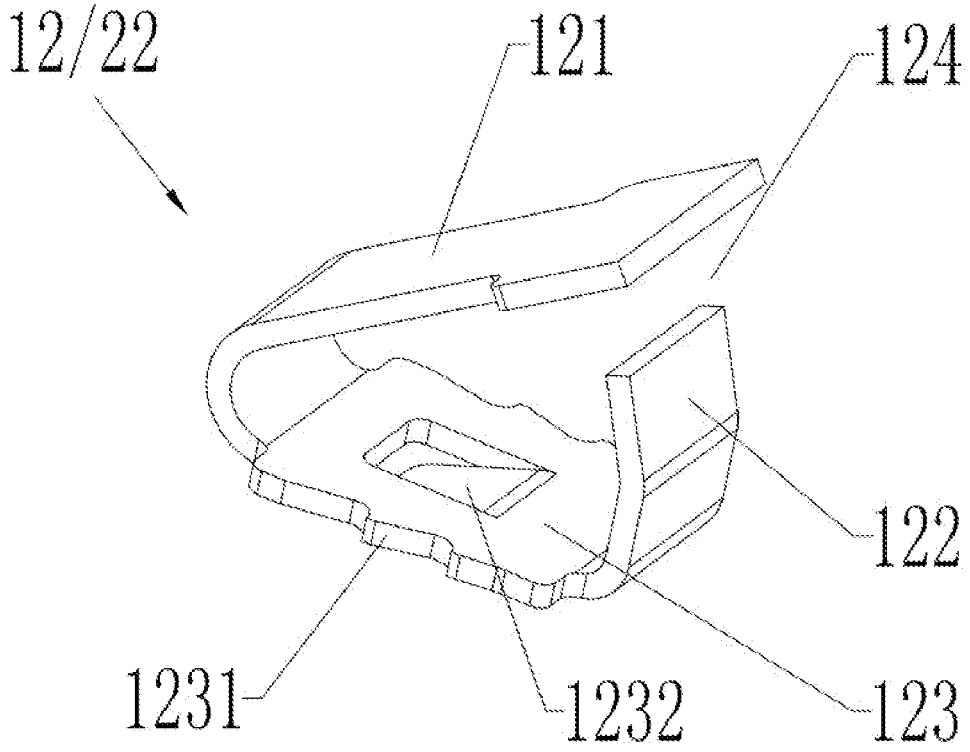
FIG. 11 is a schematic view of the structure of the first elastic member/the second elastic member of the electric connector according to an embodiment of the present application.

As shown in FIGS. 3 and 11, further, the first elastic member 12 comprises an elastic arm 121 and a limiting arm 122 that limits the deformation degree of the elastic arm 121. The elastic arm 121 applies pressure to the wire so that the conductor of the wire is closely abutted against the first connecting member 11. Specifically, the first elastic member 12 is configured into a triangular shape formed by integral bending and with a notch 124, and the elastic arm 121 and the limiting arm 122 are connected by a connecting arm 123. The inner end side of the elastic arm 121 is arranged to face the limiting arms 122 to form the aforementioned notch 124 to allow the elastic arm 121 to deform elastically only in the path of the notch 124, thereby avoiding elastic failure of the elastic arm 121. The outer end side of the elastic arm 121 is arranged to face the first connecting member 11 to form the aforementioned clamping opening. The elastic arm 121 obliquely abuts on the connecting arm 123 and is fitted with and supported by the connecting arm 123. In addition, the first elastic member 12 in the shape of a triangle is arranged on one side of the first mounting cavity 15, and the first connecting member 11 with a bar-shaped body is oppositely arranged on the other side of the first mounting cavity 15 to form a clamping opening with elastic force. In this way, it is ensured that the external conductor is clamped by each of two independent components, and the elastic clamping effect is significant.

In one of the embodiments, the clamping portions 1231 are arranged on the left and right sides of the connecting arm 123, and the support arm 1232 are arranged protrudingly on the outer end side of the connecting arm 123. In addition, the connecting arm 123 is supported and arranged in the first mounting cavity 15 to provide a stable and effective elastic support for the elastic arm 121.

In one embodiment, the male terminal 1 is provided with a plurality of wire openings side by side and connecting openings matched with the wire openings, and the configuration of the female terminal 2 is identical to that of the male terminal 1 to facilitate plug-in fitting of the male and female terminals.

Figure 6:
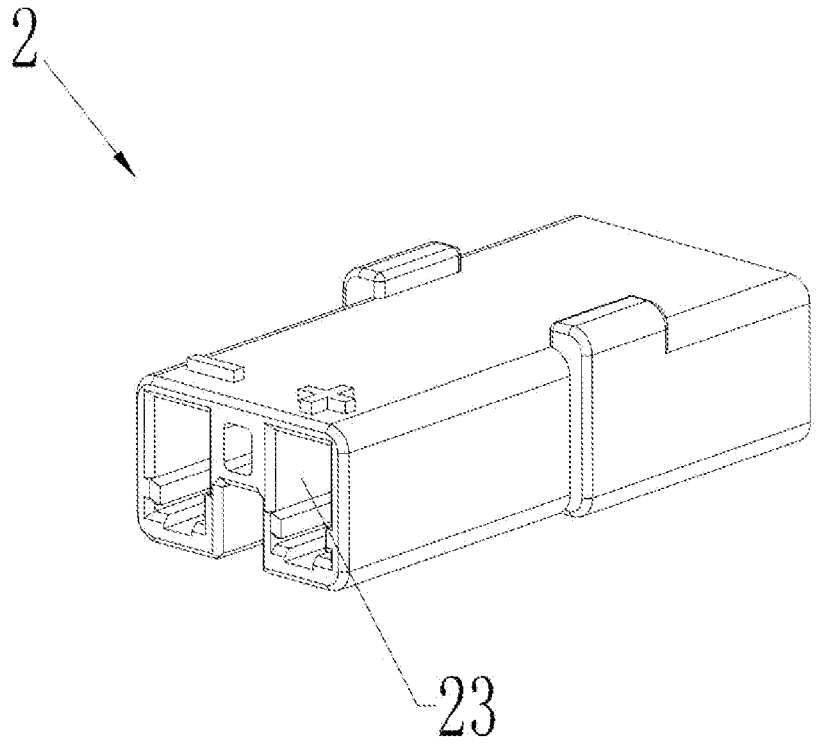
FIG. 6 is a schematic view of the structure of the female terminal of the electric connector according to an embodiment of the present application.
Figure 7:
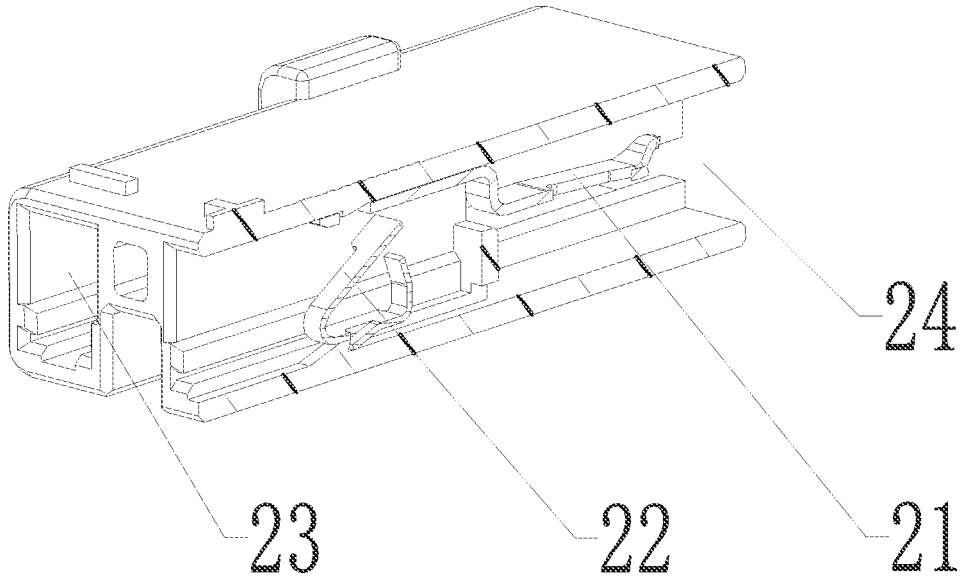
FIG. 7 is a cross-sectional view in FIG. 6.
Figure 8:
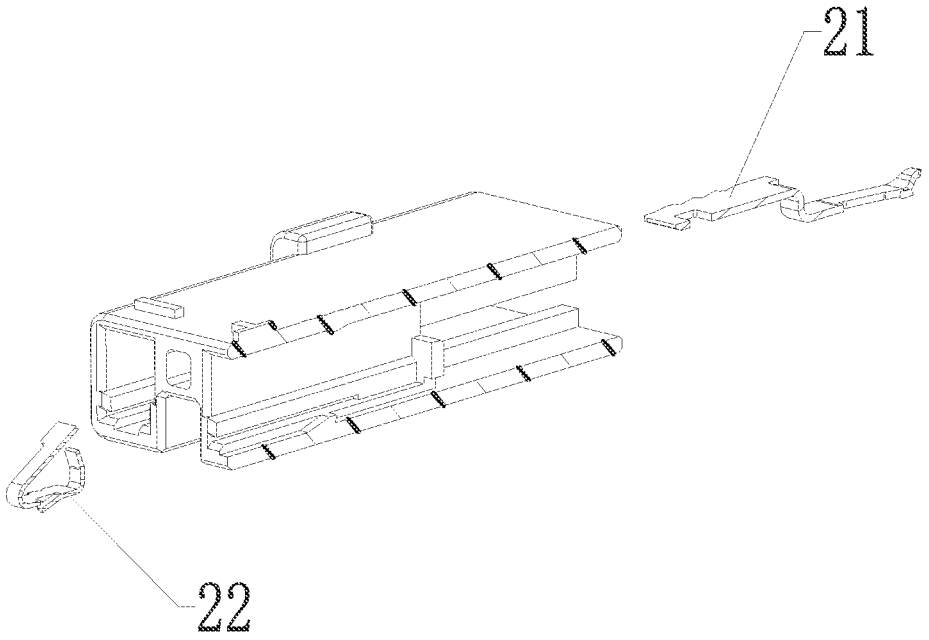
FIG. 8 is a schematic view of disassembly in FIG. 7.

As shown in FIGS. 6 to 8, correspondingly, the female terminal 2 comprises a second connecting member 21, a second elastic member 22, a second wire opening 23, and a second connecting opening 24. The second elastic member 22 can apply pressure to a wire to make a conductor of the wire closely abutted against the second connecting member 21. The second elastic member 22 and the wire pass through the second wire opening 23 and are mounted in the female terminal 2, and the second connecting member 21 passes through the second connecting opening 24 and is mounted in the female terminal 2 to realize the electric connection of the second connecting member 21 and the conductor.

In the above, the second elastic member 22 is mounted in the female terminal through the second wire opening 23, and the second connecting member 21 is fixedly mounted in the female terminal 2 through the second connecting opening 24 to prevent the second connecting member 21 from detaching out of the mounting position when receiving a pulling force towards the second wire opening 23. In addition, for the structural configuration, working principle, and implementation of the conductive elements in the female terminal 2, reference can be made to the related content of the first connecting member 11 and the first elastic member 12 of the male terminal 1, which will not be repeated herein. In addition, the elastic clamping fit of the electric connecting member and the elastic member of the female terminal 2 in the mounting cavity, as well as the mounting and limiting thereof, are generally consistent with the specific configuration of the electric connecting member and the elastic member of the male terminal 1 described above.

Figure 9:
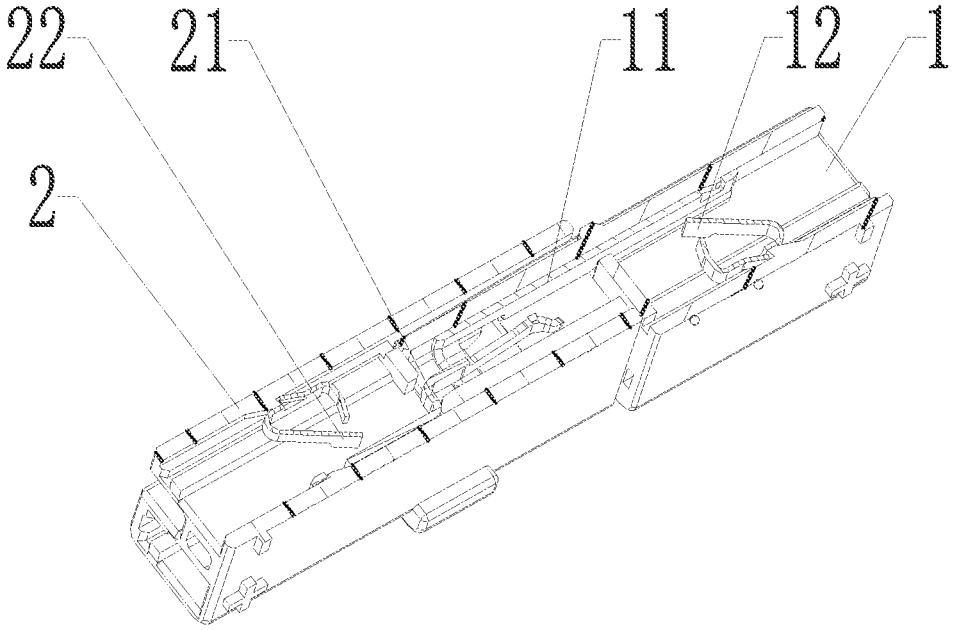
FIG. 9 is a schematic cross-sectional view of an electric connector in a working state according to an embodiment of the present application.

As shown in FIGS. 1 and 9, it is particularly critical that the male terminal 1 and the female terminal 2 can be snap-fitted with each other when the two terminals are joined. The housing of the male terminal 1 on the side of the first connecting opening 14 is configured to be snap-fitted and embedded in the second connecting opening 24 of the female terminal 2 to form a male-female-connection mode of disassembly and assembly.

Figure 10:
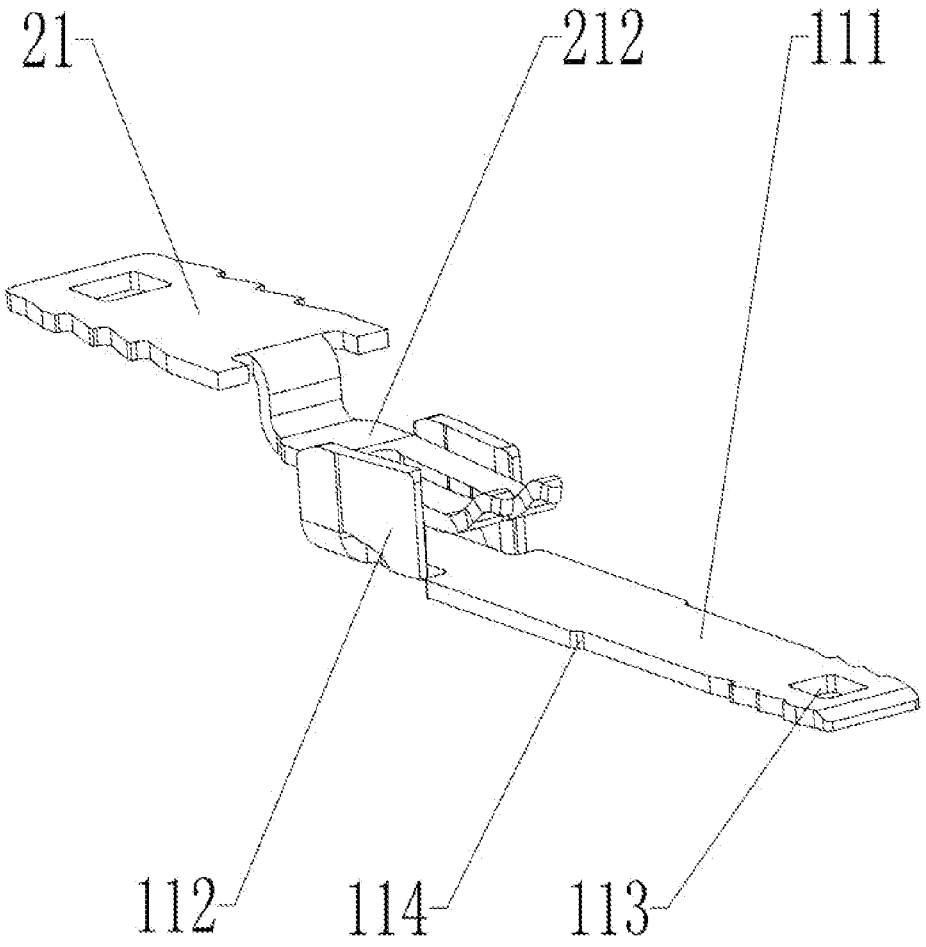
FIG. 10 is a schematic view of the structure of the first connecting member and the second connecting member in FIG. 9.

As shown in FIG. 10, the first connecting member 11 comprises an electric connecting section 111 connected to the conductor and a mating section 112 electrically connected to the second connecting member 21 of the female terminal 2. The electric connecting section 111 is closely abutted against the bottom surface of the first mounting cavity 15, and the mating section 112 is closely abutted against the bottom surface of the second mounting cavity 16. Therefore, the electric connecting member is stably supported inside the male terminal 1 to achieve a stable electric connection.

After the two terminals are assembled, the conductive elements in each terminal are brought into contact to achieve an electric connection. Specifically, the second connecting member 21 of the female terminal 2 and the first connecting member 11 of the male terminal 1 realize disassembly and assembly in a manner of end butting. The second connecting member 21 is in the shape of a plate, and one end thereof is bent and sunk to form a fork-shaped elastic structure 212. The mating section 112 of the first connecting member 11 is configured to extend upward to form an enclosed structure. After the terminals are joined, the fork-shape elastic structure 212 is elastically clamped and arranged in the enclosed structure so that the two electric connecting members are tightly clamped so as to be mechanically and electrically butted together.

In particular, the plug-in fitting formed by the bending and sinking of one end of the electric connector can adapt to the mutual butting between the two electric connecting members, making the mounting positions of the electric connecting members at their respective terminals more flexible. The floating range that allows the two ends to be effectively joined is larger, and the operability of the quick connection and quick disassembly is significantly improved.

This embodiment also provides an LED lamp. The LED lamp comprises a lamp body and the above-mentioned electric connector. The assembling configuration of the elastic members and the electric connecting members in the male terminal 1 and the female terminal 2 of the electric connector is significantly adapted to the plug-in wire use in the LED lamp, and the electric connection between them is more stable and efficient.

The above are only the preferred embodiments of the present application, and the protection scope of the present application is not limited to the above-mentioned embodiments. Any other technical solution under the idea of the present application belongs to the protection scope of the present application.

What is claimed is:

1. An electric connector, comprising:

a male terminal; wherein the male terminal comprises a first connecting member, a first elastic member, a first wire opening, and a first connecting opening; and the first elastic member comprises a first elastic arm that extends towards the first connecting member and is configured to be inserted through the first wire opening, and the first connecting member is configured to be inserted through the first connecting opening; and a female terminal; wherein the female terminal comprises a second connecting member, a second elastic member, a second wire opening, and a second connecting opening; the second elastic member comprises a second elastic arm that extends towards the second connecting member; the second elastic member is configured to be inserted though the second wire opening, and the second connecting member is configured to extend through the second connecting opening; and the first connecting member and the second connecting member are in electrical contact with each other;

wherein the male terminal and the female terminal are electrically detachable from each other; the male terminal defines a first mounting cavity and a second mounting cavity that are in communication with each other, and the first mounting cavity is located where the first wire opening is provided and communicates with the first wire opening; and the second mounting cavity is located where the first connecting opening is provided and communicates with the first connecting opening; an upper part of the first mounting cavity is provided with a mounting groove for mounting of two sides of the first elastic member and a second clamping protrusion for restricting the first elastic member at a mounting position, and the second clamping protrusion cooperates with the first elastic member to prevent the first elastic member from detaching towards a direction of the first wire opening; and at least one side of the first elastic member is provided with a clamping portion, and the clamping portion is clamped with the mounting groove to produce movement resistance.

2. An electric connector according to claim 1, wherein a partition plate is provided between the first mounting cavity and the second mounting cavity.

3. An electric connector according to claim 2, wherein a lower part of the first mounting cavity is provided with a first clamping protrusion and a limiting slot for mounting of two sides of the first connecting member, the first connecting member is provided with a hollow opening that matches with the first clamping protrusion and a step that matches with the partition plate.

4. An electric connector according to claim 1, further comprising a wire comprising a conductor, wherein the first elastic member comprises an elastic arm and a limit arm that limits a deformation degree of the elastic arm, and the elastic arm applies pressure to the wire so that the conductor of the wire is closely abutted against the first connecting member.

5. An electric connector according to claim 1, wherein the first connecting member comprises an electric connecting section connected with a conductor and a matching section electrically connected with the second connecting member of the female terminal, the electric connecting section is closely abutted against a first mounting cavity bottom surface, and the matching section is closely abutted against a second mounting cavity bottom surface.

6. An LED lamp, comprising a lamp body, wherein the LED lamp further comprises the electric connector according to claim 1.

* * * * *